United States Patent [19]

Patrie et al.

[11] 4,196,060

[45] Apr. 1, 1980

[54] METHOD OF SURFACE TREATING AN ALUMINUM WIRE FOR ELECTRICAL USE

[75] Inventors: Jos Patrie, Grenoble; Jacques Lefebvre, Voiron; Dominique Boddele, Voreppe, all of France

[73] Assignee: Societe de Vente de l'Aluminium Pechiney, France

[21] Appl. No.: 647,406

[22] Filed: Jan. 8, 1976

[30] Foreign Application Priority Data

Jan. 22, 1975 [FR] France ..... 75 02667

[51] Int. Cl.[2] ..... C25D 11/08; C25D 11/16; C25D 11/18

[52] U.S. Cl. ..... 204/28; 204/33; 204/38 A; 204/38 E; 204/58

[58] Field of Search ..... 204/28, 58, 27, 33, 204/38 E, 38 A

[56] References Cited

U.S. PATENT DOCUMENTS

| | | | |
|---|---|---|---|
| 2,174,841 | 10/1939 | Robinson | 204/58 |
| 2,700,212 | 1/1955 | Flynn et al. | 427/118 |
| 2,913,377 | 11/1959 | Brown | 204/58 |
| 3,773,631 | 11/1973 | Immel et al. | 204/58 |
| 3,799,848 | 3/1974 | Kolic et al. | 204/38 E |
| 3,844,908 | 10/1974 | Matsuo et al. | 204/58 |
| 3,865,700 | 2/1975 | Fromson | 204/28 |

FOREIGN PATENT DOCUMENTS

| | | | |
|---|---|---|---|
| 455412 | 10/1936 | United Kingdom | 204/58 |

OTHER PUBLICATIONS

"Practical Electrical Wiring", Richter, 10th Ed., 1976, pp. 103, 122.

"Degradation Mechanism of Mechanical Connectors on Al Conductors", by R. D. Naybour et al., Inst. of Electric. Engineers (Proceedings), vol. 120, No. 2, Feb. 1973, pp. 273–280.

Kirk-Othmer Encyclopedia of Chem. Technology, 2nd Ed., vol. 19, 1969, p. 575.

*Primary Examiner*—R. L. Andrews

*Attorney, Agent, or Firm*—Dennison, Dennison, Meserole & Pollack

[57] ABSTRACT

A method is disclosed for coating aluminum electrical conductors with an oxide of a controlled thickness to minimize the subsequent in situ deposition of an insulating layer of an electrically resistive oxide at the junction of the aluminum conductor and another electrical conductor.

7 Claims, No Drawings

METHOD OF SURFACE TREATING AN ALUMINUM WIRE FOR ELECTRICAL USE

The invention relates to a method of surface treating aluminum and its alloys for use as electricity conductors of small section, such as those used in low-power installations, e.g., dwellings, the contact portions thereof and for making cables. The word "aluminum" should hereinafter be understood as including aluminum itself and those aluminum alloys which have suitable electric resistivity for use as electricity conductors. The name "wire" should be understood as including any conductor of small section, regardless of the geometrical shape of the section or presence or absence of an insulating sheath.

Although it is possible to grade aluminum and its alloys according to their resistivity and to devise methods of treating wires so as to reduce resistivity, the use of such alloys in domestic installations has come up against the difficulty that the stripped portions of wire, e.g., the portions of the wire stripped of an insulating sheath at the junction with apparatus such as junction boxes, switches, etc., included in the installations, become covered in the course of time with an insulating layer of oxide which very greatly increases the resistance of the contact. This phenomenon of deterioration of a contact is not limited to contact between aluminum and copper or aluminum and aluminum, for it has also been observed with copper-copper contacts, although the surface layer of copper oxide forms more slowly and remains very thin. With aluminum alloys however the layer is so thick that engineers hesitate to use and generally forego using aluminum wires, particularly in conjunction with copper apparatus, to make up all or part of a low-power installation.

In order that aluminum can be used in such installations it has been proposed to cover it with a thin layer of a generally non-oxidizable metal such as copper, tin, lead or nickel, deposited by chemical or electro-chemical means. In some of the methods proposed the outer protective layer cannot adhere to the aluminum unless a thin film of a different metal is previously applied. The cost of such deposits and the size of apparatus required to apply them continuously have proved series obstacles to the use of wires thus coated. The idea that the formation of a layer of oxide could solve the problem was widely rejected, for it has so far been believed that, since aluminum oxide is of itself an electric insulator, a layer thick enough to protect the metal from further oxidation atmospheric agents would produce prohibitive electric contact resistance.

However, a layer of oxide 10 to 15 microns thick has been found to produce contact resistance which has to be measured by the breakdown voltage; this is at least 500 to 2,000 volts for such thicknesses. It was unexpected that one should be able to obtain a layer of oxide with the double property of permitting low contact resistance, which remains very low under severe test conditions, and of giving the metal sufficient protection, the protection being necessary to prevent the resistance from increasing considerably with the passage of time.

Contrary to generally accepted opinion, it has been discovered that a known method of developing an oxide layer on an aluminum surface, generally considered to require a minimum thickness of approximately 15 microns in order to protect the metal from atmospheric agents, can be used under special conditions to form a thin oxide layer which will permit low contact resistance between a wire thus treated and another conductor, and which will give sufficient protection to maintain this property remarkably well with the passage of time and/or under the accelerated test conditions specified by various standards, particularly the test conditions specified by Electricite de France.

Contact resistance is estimated by arranging two wires in a cross-shape under a pressure of 1 kilogram, passing a direct current from one wire to the other through the zone of contact, and measuring the contact resistance r as the quotient of the voltage applied divided by the strength of the current.

According to the invention the wire, which may have been pickled, is acted on by an alternating current in an aqueous solution containing a phosphoric acid in quantities of 50 to 400 g/liter of $H_3PO_4$ and at least one surface-active additive which exerts a foamless detergent and emulsifying action in an acid medium, for a period of 3 to 10 seconds to produce an oxide of a controlled thickness.

The additive may be selected from acid mixtures containing surface-active products and detergent products. The surface-active products may or may not be ionic, anionic and/or amphoteric; some examples are polyfluorinated organic derivatives which have a straight or branched perfluorinated chain with 4 to 20 carbon atoms, polyethoxylated fatty alcohols, substituted phenols and alkylsulfonates where the alkyl chain contains e.g. 8 or 9 carbon atoms. The detergent component may be glycols or polyethyleneglycols. The additives used must greatly reduce the surface tension of the medium to which they are added without causing foam or an oily layer to form on the surface; it is preferable for the additive to lower the surface tension of an aqueous solution of phosphoric acid containing 100 g/liter of $H_3PO_4$ at 70° C. to about 30 dynes/cm when added at the rate of 30 g/liter. As electrolysis proceeds the electrolyte acquires a milky appearance, indicating the formation of a very fine emulsion which does not hinder the operation of the bath.

The surfactants contained in the additives must be there in very small quantities, e.g., less than 3% for the above-mentioned fluorinated derivatives, about 5 to 10% for ethoxylated fatty alcohols and a few % for alkylsulfonates or substituted phenols. The polyethyleneglycols or glycols may be included in quantities of a few %, e.g. 2 to 5%. The quantity of additive used is generally from 0.5 to 30 g/liter; the optimum quantity may be determined without undue experimentation according to the composition of the additive mixture used.

Although the nature of the basic constituent of the electrolyte and the presence of the additive are essential, the other conditions of electrolysis are not critical. For example the voltage will depend, as usual, on the properties of the bath, the shape of the apparatus and the current density, which is the most important electric parameter in the process.

The current density, from 2 to 20 $A/dm^2$ and preferably from 6 to 12 $A/dm^2$ for a bath without forced circulation, may be greatly increased if provision is made for forced circulation of the bath. The voltage is generally from 4 to 45 volts and increases slowly when a bath is used. Similarly the temperature is not critical; it is determined chiefly by the nature of materials used for the apparatus and by the properties of the surfactant. The other electrode preferably consists of a material which is inert relative to the bath, such as graphite or lead which may be alloyed e.g. lead with antimony.

As already stated, the time of treatment is very short, generally from 3 to 10 seconds. This enables the wire to be treated continuously by passing it through the bath, e.g., by a method known as the "liquid current intake method" at speeds as high as 100 meters per minute for a tank 5 meters long.

The method of the invention may be applied directly to a nonoxidized wire such as a wire which has very recently been drawn, where the surface can be considered as being covered only with a more or less continuous film of the lubricant used. If the wire shows traces of irregular oxidation, such as those resulting from prolonged storage, it is preferable for it to undergo preliminary pickling by any of the appropriate known methods.

In an alternative embodiment of the invention the wire, covered with a thin layer of oxide as just described, may be passed rapidly into an electrolytic bath containing at least one metal salt, e.g. at least one salt of metals such as Ni, Co, Cu, Ag, Sn, In, Cd, Sb, Pb or Au, by a method known per se. The metal thus deposited further improves contact resistance and in most cases makes it more lasting.

The contact resistances obtained by the process just described have been compared with the contact resistances between the copper wires and those between two wires of an aluminum alloy for electrical use. The results obtained for the comparative wires are set out in Table I.

TABLE I

| | Contact resistance in microhms: | | | |
|---|---|---|---|---|
| Nature of wire | initial | after 6 weeks' natural ageing | after 8 days in a 95% water vapour bath at 53°-57° C. | after exposure to 5% saline mist at 35° C. |
| Copper | 0.3 to 0.4 | 1 to 2.9 | 0.4 to 15 | Corroded after 50 hrs. |
| Rough-drawn Al wire | 2.7 to 9 | | | insulating after 100 hrs. |
| Degreased Al wire | 1 to 8 | | | insulating after 100 hrs. |
| Pickled Al wire | 0.6 to 15 | | 13 to 49 | insulating after 100 hrs. |
| Pickled AGSL wire | 1.8 (average) | 1.8 (average) | 30 (average) | insulating after 100 hrs. |
| Wire of AGSL alloy coated with a layer of copper then a layer of tin | 0.23 (average) | 0.23 (average) | 0.7 to 1.8 | good state after 100 hrs. |

Wires coated by the method of this invention may be covered with a conventional insulating coating such as a polyvinyl chloride or polypropylene, and the above-mentioned contact properties will be preserved and regained when part of the wire is stripped for connection by pressure to another metallic component, e.g. of copper. The wires may also be assembled to form cables.

EXAMPLE 1

The bath contained 100 g/liter of $H_3PO_4$ with an additive consisting of 30 g/liter of the product sold in France by Etablissements Chevert by the name of Defetter Hl. The bath was kept at about 70° C.

The wire was a rough wire for electrical use, 2.3 mm in diameter and made of an AGSL or 6101-01 alloy, containing 0.70% of Mg and 0.60% of Si as the chief elements added.

The wire was immersed in the bath without any pickling or other surface preparation; the second electrode was made of graphite. Voltage between the wire and the electrode was 4 volts in a new bath. The treatment took 5 seconds. The current density was 6 A/dm$^2$.

Contact resistance between two strands of wire thus treated, measured on several samples, was:

after treatment, from 0.8 to 1.1 microhms, with an average of 1;

after six weeks' natural ageing, from 1.2 to 1.4 microhms with an average of 0.4;

after treatment for 8 days in a 95% saturated humid atmosphere, Standard EDF CCTU 01.01, from 0.9 to 2.7 microhms with an average of 1.6.

After 100 hours exposure to the saline mist the wire showed only a small amount of surface pitting.

EXAMPLE 2

The wire was the same as in Example 1; however, it had been pickled in an alkaline bath and neutralized in a nitric solution before being treated as described in Example 1, except that electrolysis lasted 3 seconds.

Contact resistance between strands of wire thus treated, measured on several samples and expressed in microhms, was:

after treatment, from 0.9 to 1.4 with an average of 1.1;

after six weeks' natural ageing, from 1.9 to 2.4 with an average of 2.1;

after treatment for one minute at 180° C., from 0.18 to 0.65 with an average of 0.42;

after 8 days' treatment in a vapour bath at 53°-57° C., from 1.2 to 3.2 with an average of 2.

After 100 hours' exposure to the saline mist only a small amount of incipient pitting appeared.

EXAMPLE 3

The wire was the same as in Example 1 and had been pickled as in Example 2. It was treated in a bath containing 100 g/liter of $H_3PO_4$ and 10 g/liter of a liquid product supplied by PRODUITS CHIMIQUES UGINE KUHLMANN. In addition to an aqueous solution of sulphuric acid, the chief constituents of this product are given as: a fluorinated surfactant sold by the name of FORAFAC by PRODUITS CHIMIQUES UGINE KUHLMANN of the formula $C_6F_{13}—(CH_2)_2—O+CH_2—CH_2—O+_pH$, p being from 10 to 16; polyethoxylated fatty alcohols sold by the name of UKANIL by PRODUITS CHIMIQUES UGINE KUHLMANN and particularly UKANIL 87, which is produced by condensing ethylene oxide, about 70% by weight, on a fatty alcohol with 13 to 15 carbon atoms; and a polyethyleneglycol with a mass of approximately 400, particularly EMKAPOL 400 sold by PRODUITS CHIMIQUES UGINE KUHLMANN.

Contact resistance between two strands of wire thus treated was 0.45 microhm on several samples; after eight days' exposure in the vapour bath, in accordance with Electricite de France Standard CCTU 01 01, it rose only to 1.3 microhm average value.

We claim:

1. A method of surface treating an electrical conductor wire of aluminum or aluminum alloy to form a thin oxide layer which permits low and generally stable contact resistance between a wire thus treated and another metallic conductor, comprising the steps of:

(a) subjecting the wire to the action of an alternating current which passes between the wire and another electrode through a bath of an aqueous solution containing as essential constituents about 100 to about 400 g/liter of $H_3PO_4$ and about 0.5 to about 30 g/liter of at least one surfactant selected from the group consisting of polyfluorinated organic derivatives comprising a straight or branched perfluorinated chain with 4 to 20 carbon atoms, polyethoxylated fatty alcohols, substituted phenols, glycols, polyethylene glycols, and alkylsulfonates with an alkyl chain of 8 or 9 carbon atoms that exerts a foamless detergent and emulsifying action; and (b) discontinuing the alternating current anodization after about 3 to about 10 seconds, wherein the thin oxide layer formed maintains the property of permitting low contact resistance with the passage of time.

2. A method according to claim 1 wherein the wire undergoes preliminary pickling.

3. The method of claim 1 including the further step of subjecting the wire to an alternating or direct current in a bath containing at least one salt of a metal selected from the group consisting of Ni, Cu, Sb, Pb, Ag, Sn, In, Cd, and Au.

4. The method of claim 1 wherein contact resistance between two wires thus treated is in the order of about 0.45 to about 1.4 microhms.

5. Wires coated by the method of claim 1.

6. Cables made up of wires according to claim 5.

7. Wires according to claim 1 subsequently coated with an insulating sheath.

* * * * *